US006070280A

United States Patent [19]

Ko

[11] Patent Number: 6,070,280

[45] Date of Patent: Jun. 6, 2000

[54] WATER-SEALING SWITCH STRUCTURE OF WALL-TYPE FAUCET

[75] Inventor: Hsi-Chia Ko, Changhua Hsien, Taiwan

[73] Assignee: Chung Cheng Faucet Co., Ltd., Changhua Hsien, Taiwan

[21] Appl. No.: 09/255,013

[22] Filed: Feb. 22, 1999

[51] Int. Cl.[7] ..... F16K 1/00

[52] U.S. Cl. ..... 4/678; 137/801; 251/175

[58] Field of Search ..... 4/675, 678; 137/801; 251/175

[56] References Cited

U.S. PATENT DOCUMENTS

| | | | |
|---|---|---|---|
| 3,387,816 | 6/1968 | Holycross | 137/801 X |
| 3,419,914 | 1/1969 | Moen | 4/678 X |
| 5,984,268 | 11/1999 | Doust | 251/175 |

*Primary Examiner*—Robert M. Fetsuga

*Attorney, Agent, or Firm*—Dougherty & Troxell

[57] ABSTRACT

A water-sealing switch structure of wall-type faucet, including a main body, a pull rod, a water sealing seat and a water sealing ring. A front end of the main body is formed with a spout. An inner rear side of the spout is disposed with a close wall formed with a water outlet. Two sides of the spout are respectively disposed with two restricting plates. A top edge of inner front side of the spout is disposed with a guide post formed with a through hole. An upper end of the pull rod is disposed with an enlarged head section. A lower end of the pull rod is disposed with a tapered conic post. An upper side of the conic post is formed with a small diameter engaging section. A lower end of front side of the water sealing seat has a projecting U-shaped engaging seat. A rear side thereof is disposed with a projecting ring. An inner lower edge of the projecting ring is disposed with a draining channel. A rear side of the water sealing ring is formed with a water sealing flange and a front side thereof is formed with an attaching flange with tapered thickness to define a cavity.

1 Claim, 4 Drawing Sheets

WATER-SEALING SWITCH STRUCTURE OF WALL-TYPE FAUCET

BACKGROUND OF THE INVENTION

The present invention relates to a water-sealing switch structure of wall-type faucet, in which when the water is switched to discharge from a sprinkler, no leakage will take place at the spout of the faucet. In addition, when shutting off the water supply, the pull rod on the main body of the faucet will automatically fall down to facilitate use.

FIG. 1 shows a conventional wall-type faucet including a main body 10, a pull rod 20, a water sealing seat 30 and a water sealing ring 40. A front end of the main body 10 is formed with a downward spout 11. An inner rear side of the spout 11 is disposed with a close wall 12 formed with a water outlet 13. A left and a right sides of the spout 11 are respectively disposed with two restricting plates 14. A top edge of inner front side of the spout 11 is disposed with a guide post 15 formed with a through hole 151 passing through the top face of the spout 11. An upper end of the pull rod 20 is disposed with an enlarged head section 21. A bottom face of the head section 21 is fitted with a washer 22. A lower end of the pull rod 20 is disposed with a tapered conic post 23. An upper side of the conic post 23 is formed with small diameter engaging section 24. A lower end of front side of the water sealing seat 30 has a projecting U-shaped engaging seat 31. A rear side thereof is disposed with a projecting ring 32. The water sealing ring 40 is formed with a central circular hole 41. A front side of the water seating ring 40 is formed with a flange 42 with even thickness defining a cavity 43.

When assembled, the water sealing ring 40 is fitted into the projecting ring 32 of the water sealing seat 30. The water sealing seat 30 is Placed between the close face 12 and restricting plates 14 in the spout 11. Then the pull rod 20 is downward fitted into the through hole 151 of the guide post 15. The conic post 23 of the pull rod 20 presses and passes through the U-shaped engaging seat 31 of the water sealing seat 90 with the small diameter engaging section 24 engaged with the U-shaped engaging seat 31 to complete the assembly.

Some shortcomings exist in the above arrangement as follows:

1. When the water is switched to discharge from a sprinkler (referring to FIG. 2 which is a sectional assembled view of the conventional device in a sealed state), the pull rod 20 is pulled upward to drive the water sealing seat 30 and align the the water sealing ring 40 therein with the water outlet 13. At this time, the water flows from the water outlet 13 through the circular hole 41 of the water sealing ring 40 into the cavity 43. The water impacts the rear side and the periphery thereof to compress the water sealing ring 40, whereby the rear face of the water sealing ring 40 is pressed against the peripheral close face 12 of the water outlet 13. Also, the flange 42 of the water sealing ring 40 is expanded to abut against the inner periphery of the projecting ring 32 of the water sealing seat 30 so as to sealedly shut off the water. However, the flange 42 of the water sealing ring 40 has even thickness so that the water sealing ring 40 can be hardly deformed and expanded to entirely sealedly attach to the periphery of the projecting ring 32 of the water sealing seat 30. Therefore, leakage often takes place. In addition, when the water compresses the water sealing ring 40 to make the same attach to the periphery of the water outlet 13, the water sealing ring 40 contacts with the periphery of the water outlet 13 by a large area. Therefore, the attaching force is relatively small so that an entirely sealing effect can be hardly achieved. As a result, leakage will take place.

2. When shutting off the water supply, the main body 10 of the faucet is still saturated and the cavity 43 of the water sealing ring 40 is still filled up with water. Under such circumstance, the pull rod 20 can hardly smoothly fall down and must be depressed by hand so as to restore its home position. This causes inconvenience in use.

SUMMARY OF THE INVENTION

It is therefore a primary object of the present invention to provide a water-sealing switch structure of wall-type faucet, in which an attaching flange of front side of the water sealing ring has tapered thickness, whereby when compressed by the incoming water, the attaching flange has better ability of deformation and expansions and is able to entirely sealedly attach to the periphery of the projecting ring. Moreover, the water sealing flange of rear side of the water sealing ring is attached to the close wall of the periphery of the water outlet by a small contacting area. Therefore, the attaching and compressing force is relatively large so that an entirely sealing effect can be achieved without leakage.

It is a further object of the present invention to provide the above switch structure in which when shutting off the water supply, the cavity of the water sealing ring is no more compressed by the incoming water, so that the water sealing ring will slightly restore to separate from the draining channel of inner upper edge of the projecting ring. Under such circumstance, the water originally contained in the main body and the cavity will flow out from the draining channel to destroy the saturated state, whereby the pull rod can automatically fall down.

The present invention can be best understood through the following description and accompanying drawings, wherein:

DETAILED DESCRIPTION OF THE PREFERRED EMBODIMENT

Figure 3:
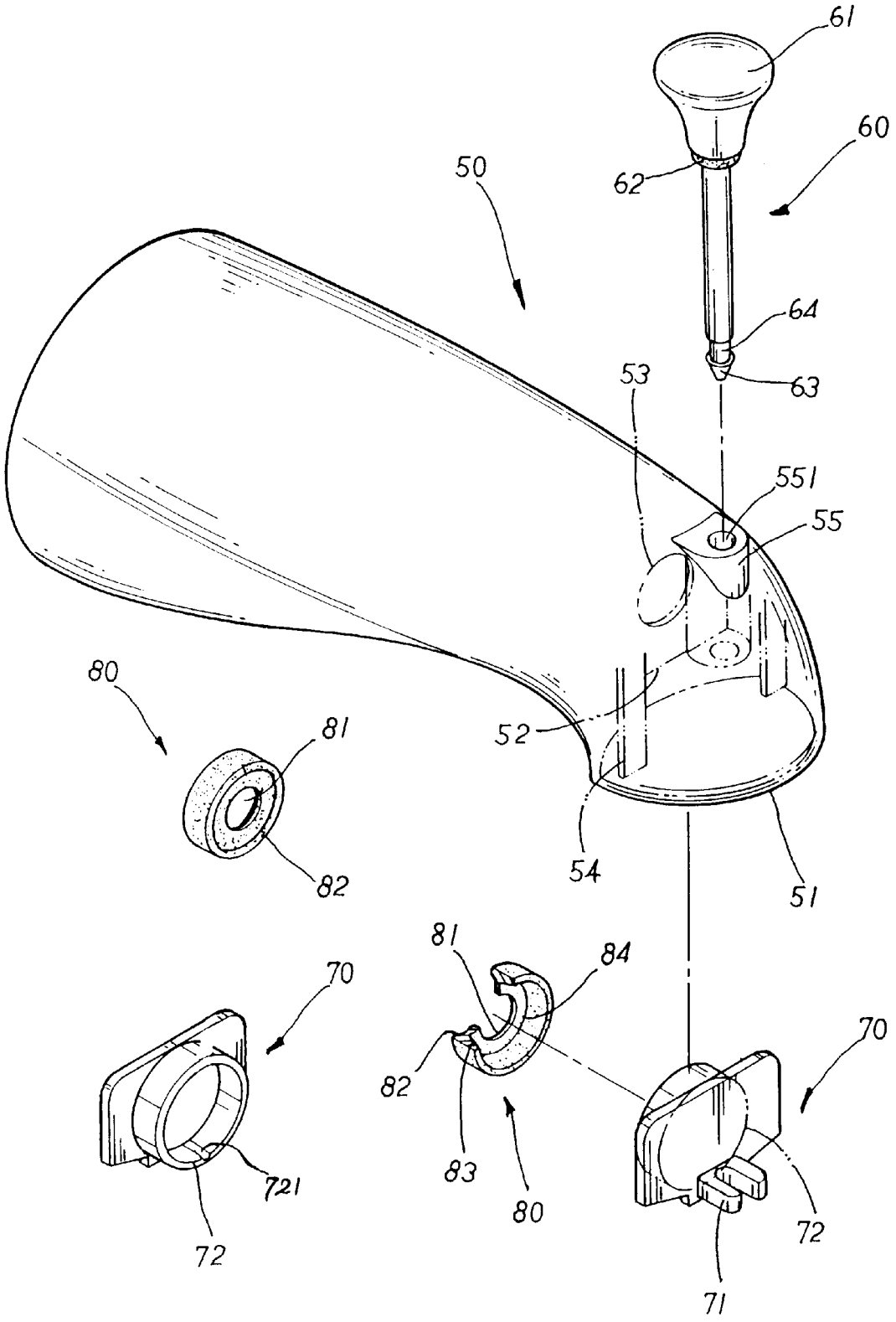
FIG. 3 is a perspective exploded view of the present invention.

Please refer to FIG. 3. The present invention includes a main body 50, a pull rod 68, a water sealing seat 70 and a water sealing ring 80. A front end of t;he rain body 50 is formed with a downward spout 51. An inner rear side of the spout 51 is disposed with a close wall 52 formed with a water outlet 53. An inner left and an inner right sides of the spout 51 are respectively disposed with two restricting plates 54. A top edge of inner front side of the spout 51 is disposed with a guide post 55 formed with a through hole 551 passing through the top face of the spout 51. An upper end of the pull rod 60 is disposed with an enlarged head section 61. A bottom face of the head section 61 is fitted with a washer 62. A lower end of the pull rod 60 is disposed with a tapered conic post 63. An upper side of the conic post 63 is formed with small diameter engaging section 64. A lower end of front side of the water sealing seat 70 has a projecting U-shaped engaging seat 71. A rear side thereof is disposed with a projecting ring 72. An inner lower edge of the projecting ring 72 is disposed with a draining channel 721. The water sealing ring 80 is formed with a central circular hole 81. A rear side of the water sealing ring 80 is formed with a water sealing flange 82. A front side thereof is formed with an attaching flange 83 with tapered thickness.

When assembled, the water sealing ring 80 is fitted into the projecting ring 72 of the water sealing seat 70. The water sealing seat 70 is placed between the close face 52 and restricting plates 54 in the spout 51. Then the pull rod 60 is downward fitted into the through hole 551 of the guide Post 55. The conic post 63 of the pull rod 60 presses and passes through the U-shaped engaging seat 71 of the water sealing sent 30 with the small diameter engaging section 64 engaged with the U-shaped engaging seat 71 to complete the assembly.

Figure 1:
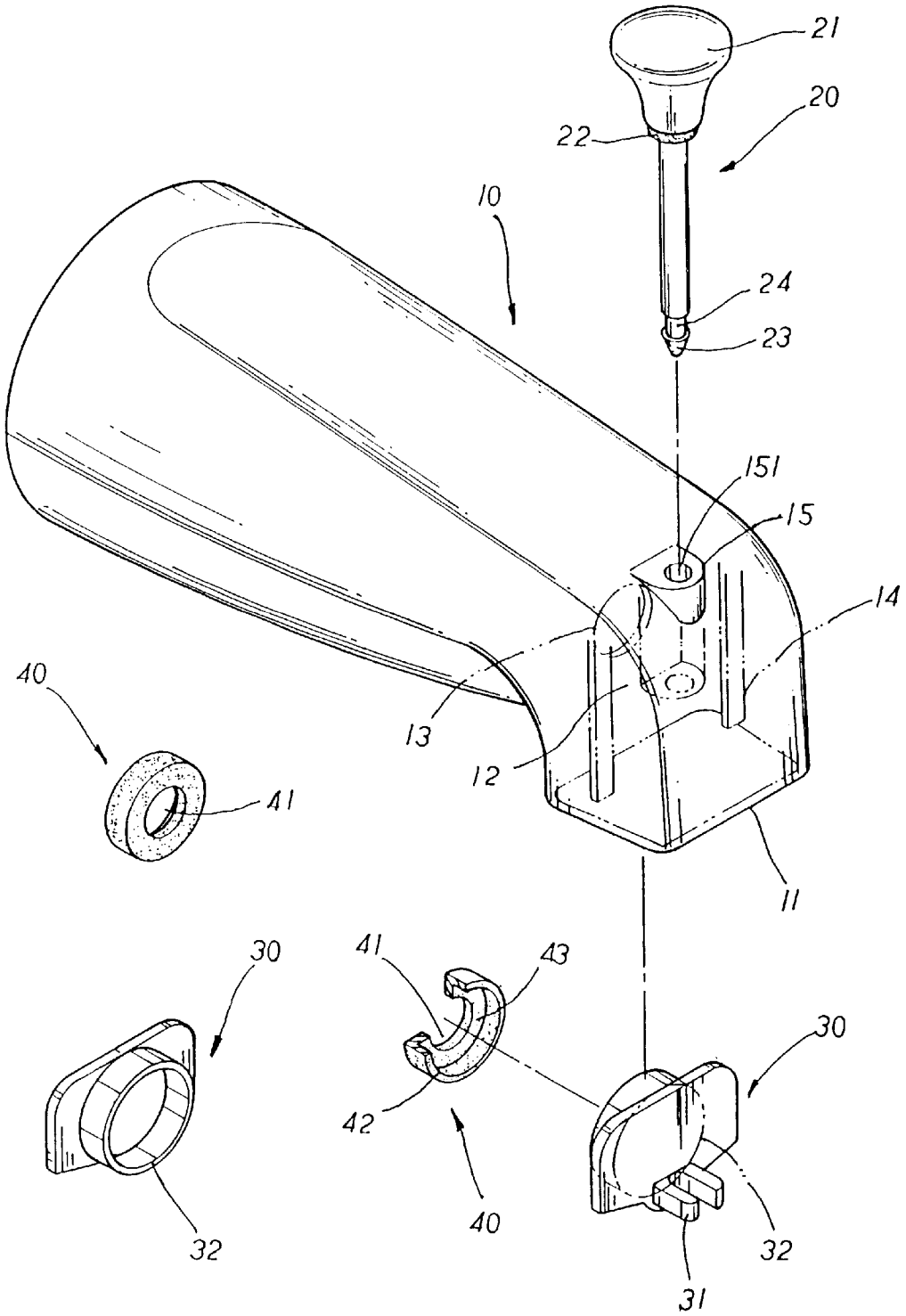
FIG. 1 PRIOR ART
FIG. 1 is a perspective exploded view of a conventional switch structure of wall-type faucet.
Figure 2:
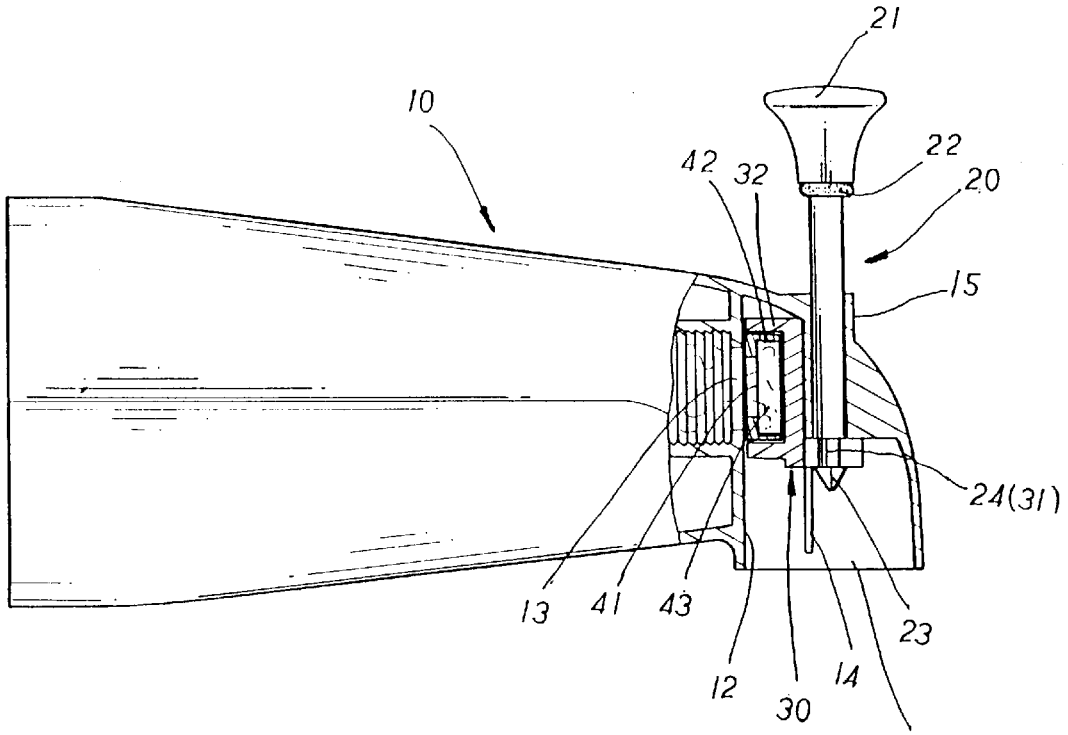
FIG. 2 PRIOR ART
FIG. 2 is a sectional assembled view of the conventional switch structure in a sealed state.
Figure 4:
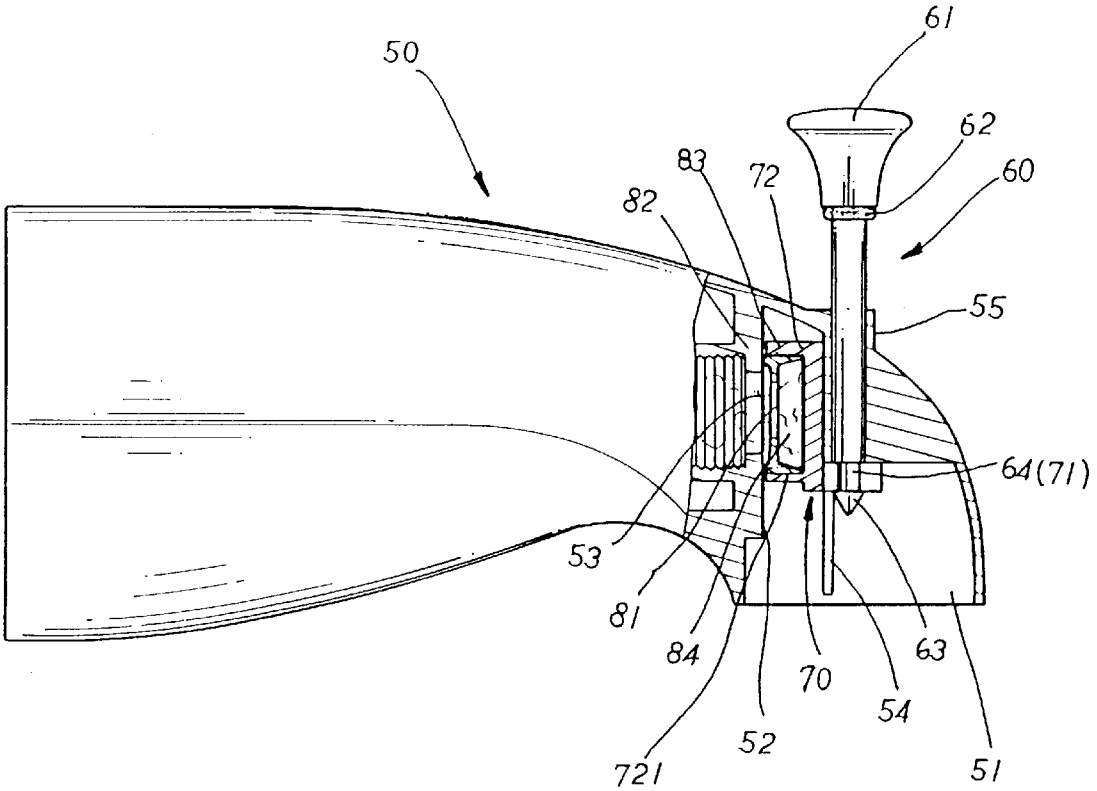
FIG. 4 is a sectional assembled view of the present invention in a sealed state.

When the water is switched to discharge from a sprinkler (referring to FIG. 4 which is a sectional assembled view of the conventional device in a sealed state), the pull rod 60 is pulled upward to drive the water sealing seat 70 and align the the waster sealing ring 80 therein with the water outlet 53. At this time, the water flows from the water outlet 53 through the circular hole 81 of the water sealing ring 80 into the cavity 84. The water impacts the rear side and the periphery thereof to compress the water sealing ring 80, whereby the water sealing flange 82 of the rear face of the water sealing ring 80 is pressed against the peripheral close face 52 of the water outlet 539. Also, the attaching flange 83 of the front side of the water sealing ring 80 is expanded to abut against and attach to the inner periphery of the projecting ring 72 of the water sealing seat 70 and the draining channel 721 so as to sealedly shut off the water.

Figure 5:
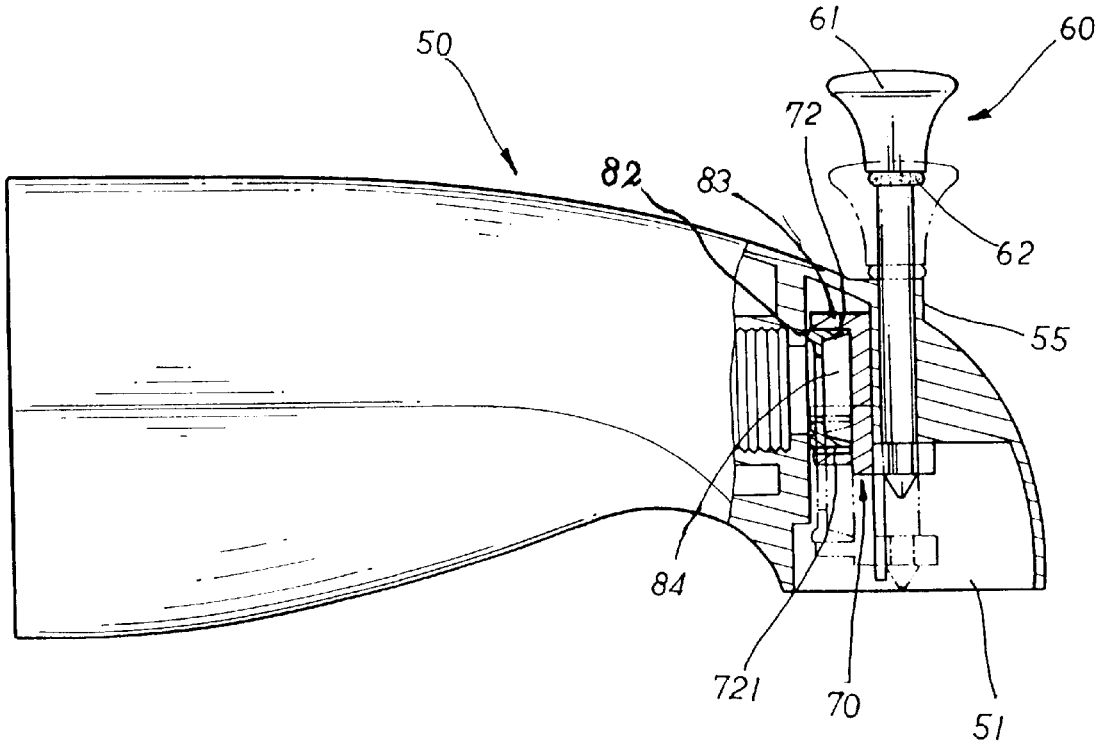
FIG. 5 is a sectional view showing the pull rod of the present invention falls down.

When shutting off the water supply (referring to FIG. 5 which is a sectional view showing that the pull rod falls down), the main body 50 of the faucet is still saturated and the cavity 83 of the water sealing ring 80 is still filled Up with water. However, without the compression of the incoming water, the water sealing ring 80 in the projecting ring 72 of the water sealing seat 70 will slightly restore to separate from the drainingi channel 721 of lower edge of the projecting ring 72. Therefore, the water in the main body 50 and the cavity 84 of the water sealing ring 80 will flow out from the draining channel 721 to destroy the saturated state of the main body. At this time, the pull rod 60 will automatically fall down (as shown by phantom line) with the washer 62 positioned on upper side of the guide post 55.

According to the above arrangement, the present invention has the following advantages:

1. When the water is switched to discharge from a sprinkler, the water in the main body 50 will flow into the cavity 84 of the water sealing ring 80 to impact the rear side and the periphery thereof to compress the water sealing ring 80. Since the attaching flange 83 of inner wall of the water sealing ring 80 is tapered so that the attaching flange 83 has better ability of deformation and expansion and is able to entirely sealedly attach to the periphery of the projecting ring 72 and the draining channel 721 without leakage. Moreover, the water sealing flange 82 of rear side of the water sealing ring 80 is attached to the close face 52 of the periphery of the water outlet 53 by a small contacting area. Therefore, the attaching and compressing force is relatively large so that an entirely sealing effect can be achieved without leakage.

2. When shutting off the water supply, without compression of the incoming water, the water sealing ring 80 will slightly restore to separate from the draining channel 721 of inner upper edge of the projecting ring 72. Therefore, the water originally contained in the main body 50 and the cavity 84 of the water sealing ring 80 will flow out from the draining channel 721 to destroy the saturated state of the main body. At this time, the pull rod 60 will automatically fall down to facilitate use.

The above description and accompanying drawings are only used to illustrate one embodiment of the present invention, Any modification or variation derived from the embodiment should fall within the scope of the present invention.

What is claimed is:

1. A water-sealing switch structure of wall-type faucet, comprising a main body, a pull rod, a water sealing seat and a water sealing ring, a front end of the main body being formed with a downward spout, an inner rear side of the spout being disposed with a close wall formed with a water outlet, an inner left and an inner right sides of the spout being respectively disposed with two restricting plates, a top edge of inner front side of the spout being disposed with a guide post formed with a through hole, an upper end of the pull rod being disposed with an enlarged head section, a bottom face of the head section being fitted with a washer, a lower end of the pull rod being disposed with a tapered conic post, an upper side of the conic post being formed with small diameter engaging section, a tower end of front side of the water sealing seat having a projecting U-shaped engaging seat, a rear side thereof being disposed with a projecting ring, the sealing ring being formed with a central circular hole, the water sealing ring being fitted into the projecting ring of the water sealing seat, the water sealing seat being placed into the spout, the pull rod being downward fitted into the through hole of the guide post with the small diameter engaging section of the pull rod drivingly engaged with the U-shaped engaging seat, said switch structure being characterized in that:

an inner lower edge of the projecting ring of the water sealing seat is disposed with a draining channel; and a rear side of the water sealing ring is formed with a water sealing flange and a front side thereof is formed with an attaching flange with tapered thickness, whereby when the water is switched to discharge from a sprinkler, the incoming water will impact and compress the rear side and the periphery of the water sealing ring fitted in the projecting ring of the water sealing seat, whereby the water sealing flange of the rear side of the water sealing ring is pressed against the close face of the periphery of the water outlet and the attaching flange of the front side of the water sealing ring is expanded and deformed to sealedly attach to the inner periphery of the projecting ring of the water sealing seat and the draining channel so as to reliably seal the water outlet.

* * * * *